US005655332A

United States Patent [19]

Papadopoulos

[11] Patent Number: 5,655,332

[45] Date of Patent: Aug. 12, 1997

[54] PRE-HUNG DOOR INSTALLATION APPARATUS

[75] Inventor: Fotios Papadopoulos, Delta, Canada

[73] Assignee: Stronghold Construction Ltd., Delta, Canada

[21] Appl. No.: 360,636

[22] Filed: Dec. 21, 1994

Related U.S. Application Data

[63] Continuation of Ser. No. 250,676, May 27, 1994, abandoned, which is a continuation-in-part of Ser. No. 70,194, Jun. 2, 1993, abandoned.

[51] Int. Cl.[6] ..... E06B 1/00

[52] U.S. Cl. ..... 49/380; 206/325

[58] Field of Search ..... 49/380; 206/325; 292/259 R, 289

[56] References Cited

U.S. PATENT DOCUMENTS

| | | | |
|---|---|---|---|
| 2,720,308 | 10/1955 | Howell | 206/46 |
| 2,919,798 | 1/1960 | Gottlieb | 206/60 |
| 2,930,480 | 3/1960 | Brown | 206/60 |
| 3,301,820 | 1/1967 | Haendiges | 206/60 |
| 3,584,416 | 6/1971 | Baumgartel | 49/380 |
| 3,599,373 | 8/1971 | Coykendall | 49/380 |
| 4,718,195 | 1/1988 | Ortega | 49/380 |
| 4,779,910 | 10/1988 | Dameron | 292/259 R |
| 5,282,656 | 2/1994 | Fizer | 292/259 R |

*Primary Examiner*—Kenneth J. Dorner
*Assistant Examiner*—Jerry Redman

[57] ABSTRACT

An apparatus for installing a pre-hung door unit including a door frame having an inwardly facing portion accessible from an outside facing side of the door unit and a door hingedly connected to the door frame. The apparatus includes a body having door edge portion connecting provisions for removably connecting the body to an edge portion of the door and frame connecting provisions connected to the door edge portion connecting provisions, for removably connecting the body to an inwardly facing portion of the door frame. The door edge portion connecting provisions include a door edge connecting portion having a first surface for contacting an edge surface of the door and the frame connecting provisions include a frame connecting portion having a second surface operable to contact a surface of the inwardly facing portion of the door frame.

20 Claims, 13 Drawing Sheets

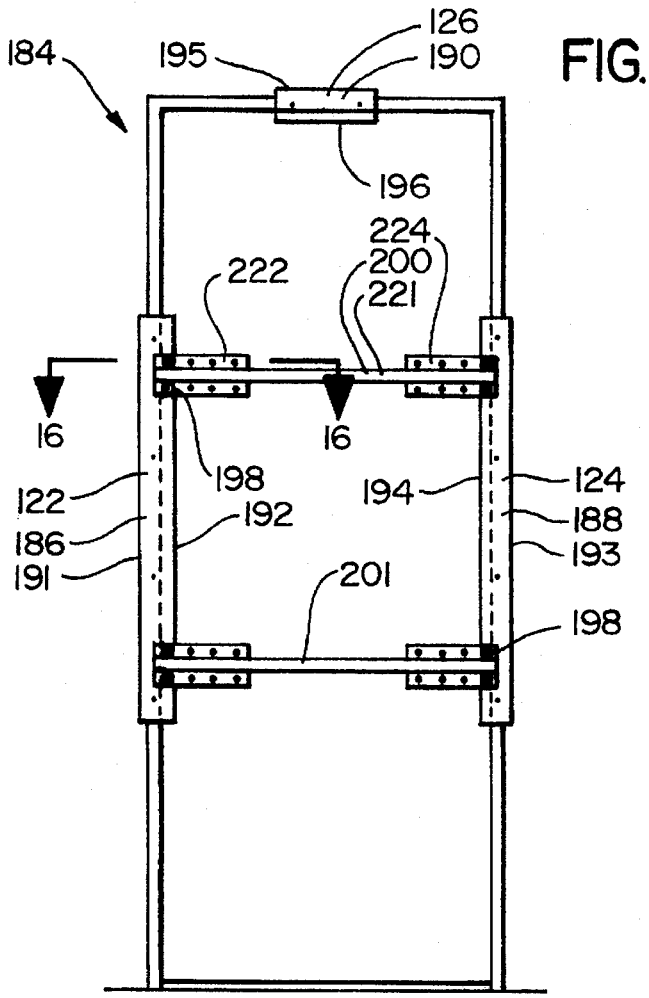
FIG. 15
FIG. 17
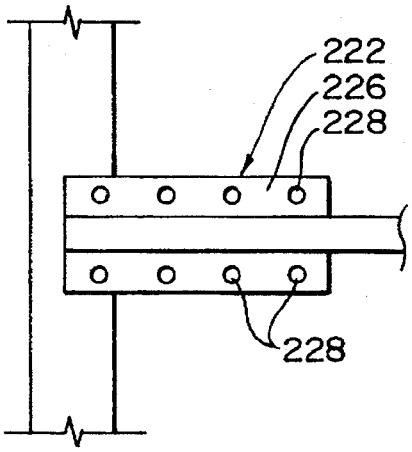
FIG. 16
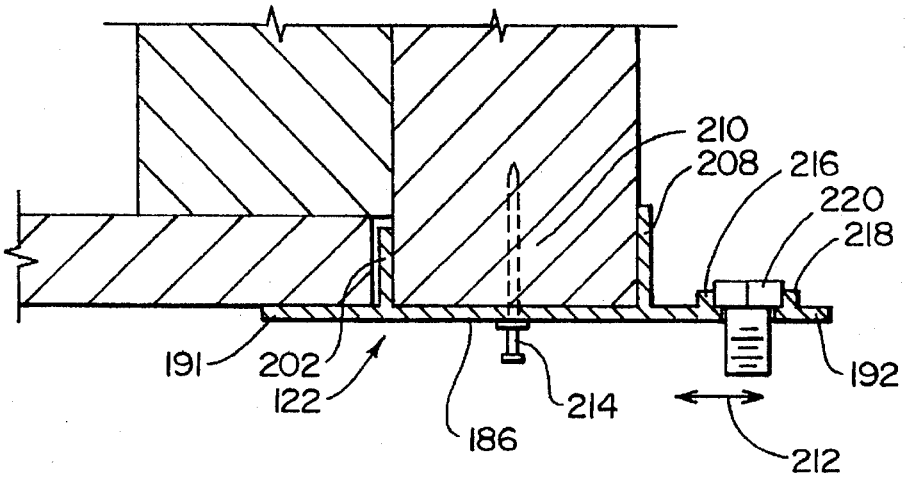

PRE-HUNG DOOR INSTALLATION APPARATUS

CROSS REFERENCES TO RELATED APPLICATIONS

This is a continuation application of U.S. patent application Ser. No. 08/250,676 filed May 27, 1994, now abandoned, which is a continuation-in-part application of U.S. patent application Ser. No. 08/070,194 filed Jun. 2, 1993, now abandoned.

BACKGROUND OF THE INVENTION

This invention relates to apparatuses for simplifying the installation of a pre-hung door unit, in particular to devices for holding the door closed during transportation and installation and to devices assisting in the transportation and manipulation of the door unit.

Pre-hung door units are commonly installed in door openings of newly constructed houses. Such openings may define passageways between adjacent rooms or may define passageways from the inside of a room to the outside thereof.

When a pre-hung door unit, comprised of a frame and a door hingedly connected to the frame, is transported or is in the process of being installed, care must be taken to ensure that the door does not undesirably swing open. One device for this purpose is described in U.S. Pat. No. 4,718,195 to Ortega. This device employs a first tab member installed on the frame and a second, slotted member installed on the door in such a manner that the tab may be received in the slotted member when the door is closed. Typically, these components are installed in pre-defined areas designed for conventional door locks. A portion of the tab projects through the slot and is forcibly bent over the slotted member on an inside facing side of the door, to prevent the door from opening during transportation and installation. After the door unit is installed, the tab and slotted members are removed, from the inside facing side of the door, and locks are installed in the conventional manner.

U.S. Pat. No. 3,301,820 to Haendiges discloses another door installation device which appears to be a clip member which grips outside portions of a door and door frame associated with a pre-hung aluminum door. The clip is under tension to hold the door securely to the door frame.

Unfortunately, the Ortega device is installed on an inside facing side of the door and door frame and therefore to effectively install a pre-hung door employing this device would require two installers including one on the outside of the room to help position the unit from outside the room and one on the inside of the room to remove the installation devices after the door is installed. Naturally, this increases the cost of installation because two installers are required.

The Haendiges device is removable from the outside of the room but it requires co-operating surfaces on the door and frame which can be gripped by the device. Conventional wooden doors and door frames have flat surfaces and provide no such co-operating surfaces.

What is required therefore is a device which maintains a wooden or smooth surfaced door closed during transportation and installation but which can be removed from outside the room. This would eliminate the need for an installer on the inside of the room. In addition, preferably, the device leaves no visible marks on the door or on the frame.

Another problem with pre-hung doors is their size which makes it difficult for one installer to lift and manipulate the door unit into place. Typically, pre-hung door units have no conveniently located handles and therefore the installer can only grasp opposite sides of the frame which typically do not provide a good gripping surface. What is required therefore is a device which does provide a good gripping surface for an installer and which can easily be removed from the pre-hung door unit after the door is installed.

The present invention addresses the needs above.

SUMMARY OF THE INVENTION

In accordance with one aspect of the invention, there is provided an apparatus for installing a pre-hung door unit including a door frame having an inwardly facing portion accessible from an outside facing side of the door unit and a door hingedly connected to the door frame. The apparatus includes a body having door edge portion connecting means for removably connecting the body to an edge portion of the door and frame connecting means connected to the door edge portion connecting means, for removably connecting the body to an inwardly facing portion of the door frame. The door edge portion connecting means includes a door edge connecting portion having a first surface for contacting an edge surface of the door and the frame connecting means includes a frame connecting portion having a second surface operable to contact a surface of the inwardly facing portion of the door frame.

Preferably, the first and second surfaces are flat planar surfaces lying in first and second parallel, spaced apart planes respectively and the door and frame connecting portions are connected together by an angled portion generally at right angles to the first and second planes.

Preferably, the door connecting portion and the angled portion are operable to be disposed between the edge portion of the door and the door frame.

Preferably, the apparatus includes aligning means for aligning an inner planar surface of the door with an inside facing surface of the door frame such that the surfaces lie in coincident planes. Preferably, the aligning means includes a frame alignment portion having a flat planar frame alignment surface for contacting the inside facing surface of the frame, the flat planar frame alignment surface lying in a frame alignment plane and being located at a pre-defined alignment position with respect to the door edge connecting means. Also preferably, the apparatus includes a door alignment portion on the body, the door alignment portion having a door alignment surface lying in a door alignment plane, for contacting the inner planar surface of the door. Preferably, the frame alignment plane and the door alignment plane are parallel to each other and preferably, the frame alignment plane and the door alignment plane are coincident.

It is also desirable that the apparatus includes a door connector having a first receptacle for cooperating with a first retainer for retaining the body against the door edge portion and preferably, the frame connecting portion includes a frame connector for cooperating with a frame retainer for retaining the body against the door frame, the frame connector including a second receptacle for engaging the frame retainer.

Preferably, the first receptacle and second receptacles are formed from first and second projections respectively, the first and second projections extending from the body and longitudinally therealong.

It is desirable that the apparatus include a first retainer for retaining the body against the door edge portion, the first retainer including a first flexible tension member having first and second end portions, the first end portion being operable to connect to the door connector to secure the first tension member thereto, and the second end portion being operable to connect to the door. Preferably, the first end portion has a first clip for cooperating with and for connecting to the door connector and preferably, the second end portion has a hook member for connecting to a hinge edge of the door, opposite the door edge portion to secure the first flexible tension member thereto.

It is desirable that the first flexible tension member include a first tensioner for tensioning the first flexible tension member to urge the body against the door edge portion.

It is also desirable that the apparatus includes a frame connector on the frame connecting portion and a frame retainer operable to cooperate with the frame connector to retain the body against the door frame. Preferably, the frame retainer includes a door frame cooperating portion and a body connecting portion for connecting the frame retainer to the frame connector on the body, such that the frame retainer urges the body against the door frame. Preferably, the door frame cooperating portion and the body connecting portion are disposed at an angle relative to each other such that the door frame cooperating portion is operable to contact an outwardly facing surface of the door frame while the body connecting portion is engaged with the frame connector. Preferably, the frame connector includes a second projection extending from the body and the body connecting portion includes a curved projecting portion operable to hook onto the second projection to resist any tendency of the curved projecting portion to come free of the projection.

In accordance with another aspect of the invention there is provided an apparatus for installing a pre-hung door unit including a door frame having an inwardly facing portion accessible from an outside facing side of the door unit and a door hingedly connected to the door frame and having a door edge portion. Preferably, the apparatus includes a body having door edge portion connecting means for removably connecting the body to an edge portion of a door, and a frame connecting portion for removably connecting the body to an inwardly facing portion of the door frame. Preferably, the door edge portion connecting means includes a channel portion formed in the body, the channel portion including first and second parallel upstanding side portions, and a door edge connecting portion connecting the first and second parallel upstanding side portions, the door edge portion being received between the first and second parallel upstanding portions such that an inner surface and an outer surface of the door edge portion are closely adjacent the first and second parallel upstanding portions, and such that an edge surface of the door edge portion contacts the door edge connecting portion. Preferably, the door edge portion connecting means further includes a door connector including first and second connectors disposed on the first and second upstanding portions respectively for cooperating with a first retainer for retaining the body against the door edge portion. Preferably, the frame connecting portion includes a frame connector for cooperating with a frame retainer for retaining the body against the door frame.

In accordance with another aspect of the invention, there is provided an apparatus for installing a pre-hung door unit including a door frame having an inwardly facing portion accessible from an outside facing side of the door unit and a door hingedly connected to the door frame. Preferably, the apparatus includes a body having door edge portion connecting means for removably connecting the body to an edge portion of the door and frame connecting means connected to the door edge connecting means, for removably connecting the body to an inwardly facing portion of the door frame. Preferably, the door edge portion connecting means includes a channel portion formed in the body, the channel portion including first and second parallel upstanding side portions connected together by a door edge connecting portion, the door edge portion being received between the first and second parallel upstanding portions such that an inner surface and an outer surface of the door edge portion are closely adjacent the first and second parallel upstanding portions, and such that an edge surface of the door edge portion contacts the door edge connecting portion.

Preferably, the frame connecting means includes a frame connecting portion connected to the second upstanding portion to extend at a right angle relative thereto, the frame connecting portion being positioned on an inwardly facing portion of the frame when the apparatus is installed.

Preferably, the apparatus includes aligning means for aligning an inner planar surface of the door with an inside facing surface of the door frame.

BRIEF DESCRIPTION OF THE DRAWINGS

In drawings which illustrate embodiments of the invention,

FIG. 15 is a front view of an additional apparatus according to a fourth embodiment of the invention;

FIG. 16 is a cross-sectional view of a door frame portion on which a side member according to the fourth embodiment of the additional apparatus is installed, as would be viewed along lines 15—15 in FIG. 15;

FIG. 17 is a plan view of a connecting member according to the fourth alternative embodiment of the additional apparatus;

DETAILED DESCRIPTION

Figure 1:
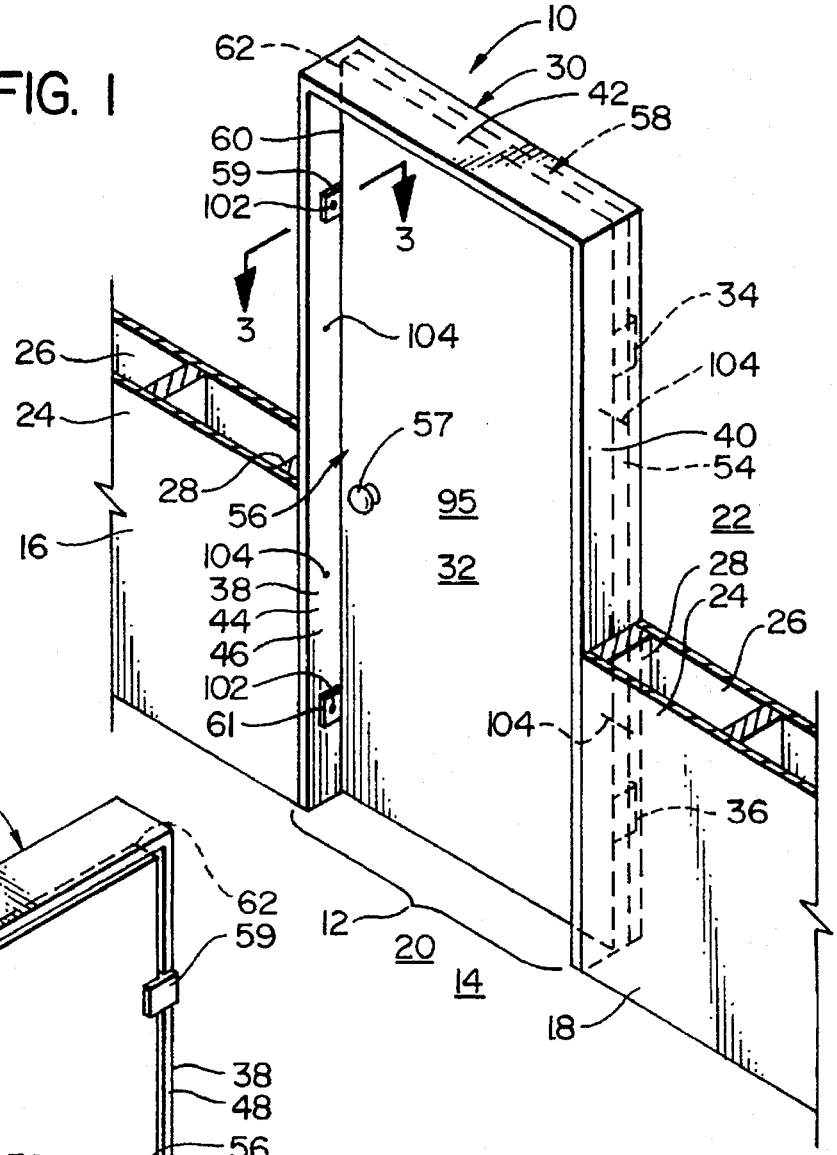
FIG. 1 is a broken perspective view of a pre-hung door according to a first embodiment of the invention, viewed from outside a room in which the door unit is installed.

FIG. 1—First Embodiment

Referring to FIG. 1, a pre-hung door unit according to a first embodiment of the invention is shown generally at 10. The pre-hung door unit is installed in a door opening shown generally at 12 defined by first and second adjacent walls 16 and 18 of a room 14. The room has an outside shown generally at 20 and an inside shown generally at 22. The room is of conventional construction wherein each wall 16 and 18 is comprised of first and second wallboard panels 24 and 26 and studs 28.

The pre-hung door unit 10 includes a door frame shown generally at 30 and a door 32 hingedly connected to the frame by hinges 34 and 36. The frame is comprised of first, second and third frame members 38, 40 and 42, the first and second frame members 38 and 40 being parallel and upright with the third frame member extending therebetween at an upper portion thereof. The frame members 38, 40 and 42 have respective inwardly facing portions, only inwardly facing portion 44 being shown in FIG. 1. The inwardly facing portion 44 has a flat surface 46. It will be appreciated that the inwardly facing portion 44 is disposed on the outside 20 of the room and therefore is accessible from outside the room, when the door 32 is closed, as shown in FIG. 1.

FIG. 2

Figure 2:
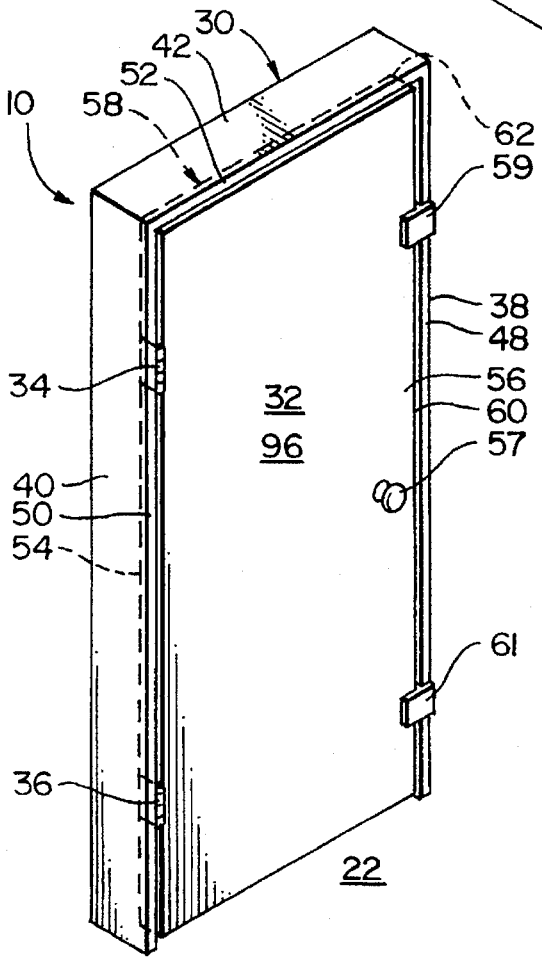
FIG. 2 is a perspective view of the door unit viewed from inside the room.

Referring to FIG. 2, the frame members 38, 40 and 42 have inside facing planar surfaces 48, 50 and 52 respectively. These surfaces may be collectively referred to as an inside facing surface of the door frame.

Referring to FIGS. 1 and 2, the door has a hinge side shown generally at 54 and a door knob side shown generally at 56. Of course, the hinges 34 and 36 are secured to the hinge side 54 and a door knob 57 is secured to the door knob side in the conventional manner. The hinges permit the door 32 to swing open toward the inside 22 of the room.

The door also has an inner surface 96 and an outer surface 95, facing inwardly and outwardly respectively, toward the inside 22 and outside 20 of the room respectively. For this explanation, the entire perimeter of the door will be referred to as an edge portion 58 and in this embodiment, the description will relate primarily to an edge portion 60 associated with the door knob side 56 of the door 32.

The edge portion 60 has a flat planar edge surface 62 which extends the entire length of the door and has an outside facing surface portion 63 and an inside facing surface portion 65 on the outer and inner surfaces 95 and 96 respectively.

The pre-hung door unit 10 further includes first and second door installation apparatuses 59 and 61 which are secured to the door 32 and the frame member 38 for the purpose of securing the door to the frame to prevent unwanted opening of the door during transportation and installation of the pre-hung door unit and to properly align the door with the frame as will be explained below.

Figure 3:
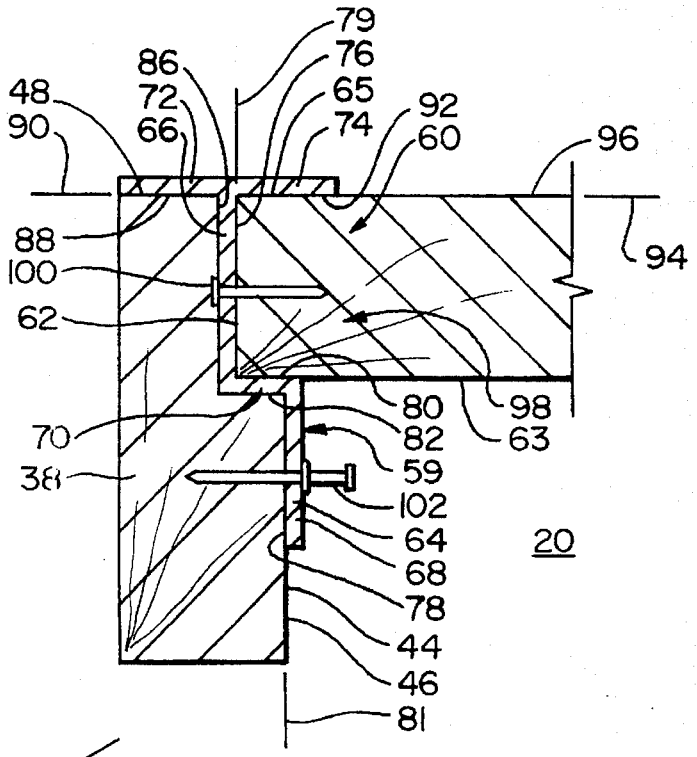
FIG. 3 is a cross-sectional view of a door installation apparatus according to the first embodiment.
Figure 4:
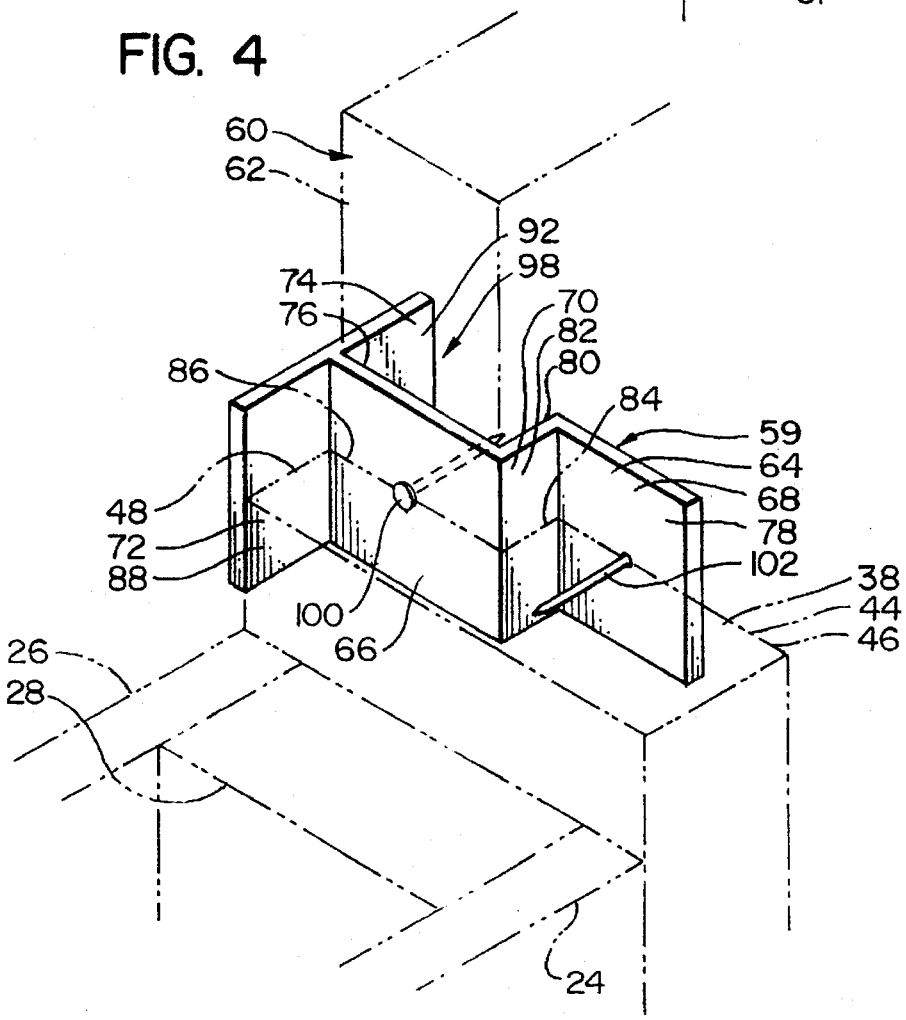
FIG. 4 is a perspective view of the door installation unit with a door, door frame and adjacent wall being shown in broken outline.

FIGS. 3 and 4

Referring to FIGS. 3 and 4, the pre-hung door installation apparatus 59 is generally the same as apparatus 61 and therefore only apparatus 59 will be described. Apparatus 59 is formed from an extruded aluminum member into a body 64 having a door edge connecting portion 66, a frame connecting portion 68, a right angled portion 70, a frame alignment portion 72 and a door alignment portion 74.

The door edge connecting portion 66 has a first flat planar surface 76 operable to contact the flat planar edge surface 62 of the door. The frame connecting portion 68 has a second flat planar surface 78 which is operable to contact the flat surface 46 of the inwardly facing portion 44 of the frame member 38. The first and second flat planar surfaces 76 and 78 lie in first and second parallel spaced apart planes 79 and 81 respectively. The right angled portion 70 extends at right angles relative to the first and second flat planar surfaces 76 and 78 and has a door facing surface S0 and a frame facing surface 82 of appropriate lengths to enable the right angled portion to be disposed between the door edge portion 60 and a cutout portion 84 in the frame member 38.

Preferably, all portions of the body 64 are approximately 1/16 inches thick. The thickness of the door edge connecting portion 66 serves to space the edge surface 62 from an adjacent frame surface 86 by approximately 1/16 of an inch to allow clearance for the door to swing open. The thickness of the right angled portion 70 serves to space the outside facing surface portion 63 approximately 1/16 inch away from the cutout portion 84 to provide clearance for installation of weatherstripping after the pre-hung door unit 10 is installed.

Preferably, the lengths of the frame alignment portion 72, the door edge connecting portion 66, the right angled portion 70 and the door frame connecting portion 68 are chosen such that they generally follow the contour of the frame member 38. Similarly, the spacing between the right angled portion 70 and the door alignment portion 74 is chosen such that the door edge portion 60 is complementarily received therein.

The frame alignment portion 72 has a flat planar frame alignment surface 88 lying in a frame alignment plane the frame alignment surface being operable to contact the inside facing surface 48 of the frame member 38. The frame alignment surface 88 is located at a pre-defined spatial position relative to the door edge connecting portion, this pre-defined position being determined by the cross sectional shape of the frame. In the embodiment shown, the frame has somewhat of a step shape in cross section which places the inside facing surface 48 of the frame at a particular spatial position with respect to the adjacent frame surface 86, immediately adjacent the door. Hence the body is formed with the frame alignment surface 88 at a pre-defined alignment position with respect to the door edge connecting portion.

Similarly, the door alignment portion 74 has a door alignment surface 92 lying in a door alignment plane 94, the door alignment surface 92 being operable to contact the inner surface 96 of the door. Generally, the frame alignment plane and the door alignment planes 90 and 94 are parallel and preferably are coincident as shown in FIGS. 3 and 4. This causes the inner surface 96 of the door to be aligned with the inside facing surface 48 of the frame. The door and frame thus appear "flush".

Basically, the door edge connecting portion 66, the right angled portion 70 and the door alignment portion 74 act as a channel portion indicated generally at 98 wherein the door alignment portion 74 and right angled portion 70 act as first and second parallel upstanding side portions with the door edge connecting portion 66 connected therebetween. The door edge portion 60 is received between the door alignment portion 74 and the right angled portion 70 such that the inside facing surface portion 65 and the outside facing surface portion 63 are closely adjacent the door alignment portion 74 and the right angled portion 70 respectively and such that the edge surface 62 of the door edge portion 60 contacts the first flat planar surface 76. In the embodiment shown, the phrase closely adjacent is meant to mean in contact with although, in other embodiments the door edge portion need not touch both the connecting portion and the door alignment portion.

When the body 64 is considered to have the above described channel portion 98, the frame connecting portion 68 may be considered to be connected to the right angled portion 70 to extend a right angle relative thereto.

Operation

Firstly, with the door secured to the frame by hinges 34 and 36 as shown in FIGS. 1 and 2, the door is swung open to enable the body 64 to be installed on the door edge portion 60. Referring to FIG. 4, the door edge portion 60 is received between the door alignment portion 74 and the right angled portion 70 until the edge surface 62 contacts the first flat planar surface 76. Referring to FIG. 4, a nail 100 is then driven through the door edge connecting portion 66 to secure the door edge portion 60 in the channel portion 98.

The door is then swung closed until the frame alignment surface 88 contacts the inside facing surface 48 of the frame member 38. At this point, the frame facing surface 82 will be in contact with the corresponding portion of the frame and the second flat planar surface 78 will be in contact with the inwardly facing portion 44 of the frame member 38. A second, double headed nail 102 may then be driven through the frame connecting portion 68 to secure the body 64 to the frame member 38, thereby securing the door 32 to the frame member 38. The door 32 is thus prevented from swinging open during transportation and installation of the pre-hung door unit 10.

Referring to FIG. 1, when the pre-hung door unit 10 is installed in the door opening 12, nails 104 are hammered into the inwardly facing surfaces of the first and second frame members 38 and 40 to secure the frame 30 to adjacent studs 28. With the frame 30 so installed, the installer may remove the double headed nails 102 thereby freeing the apparatuses 59 and 61 from the frame member 38 and permitting the door 32 to swing open toward the inside 22 of the room. Then, with the door swung open, the installer can insert a claw of a hammer (not shown) between the door edge connecting portion 66 and the door edge portion 60 to pry the body 64 from the door edge portion 60. The door 32 may then be opened and closed in the usual manner.

It will be appreciated therefore that the channel portion 98 acts as door edge portion connecting means for removably connecting the body to an edge portion of the door and the frame connecting portion 68 acts as frame connecting means connected to the door edge connecting means, for removably connecting the body to an inwardly facing portion of the door frame.

It should be appreciated that with the frame connecting means, specifically the frame connecting portion 68 extending on the inwardly facing portion 44 of the frame member 38, the installer can simply remove the double headed nail 102 by addressing the nail from outside 20 the room. It will be appreciated that the installer typically will nail the frame to the 2×4 studs 28 from outside the room and then may simply and expeditiously remove nails 102 from apparatuses 59 and 61 thereby enabling the door to swing open to enable the apparatuses 59 and 61 to be pried from the door edge portion 60. Since the installer can perform the operations of securing the frame members to the adjacent studs 28 and removal of the nails securing the frame connecting portions 68 of the apparatuses 59 and 61, all from outside the room, the installer need only open the door, from outside 20 the room to gain access to the respective bodies to enable them to be removed from the door edge portion 60. This provides a considerable time saving to an installer who can perform the entire operation of installing the pre-hung door unit all by access from outside the room.

Alternatives

Figure 5:
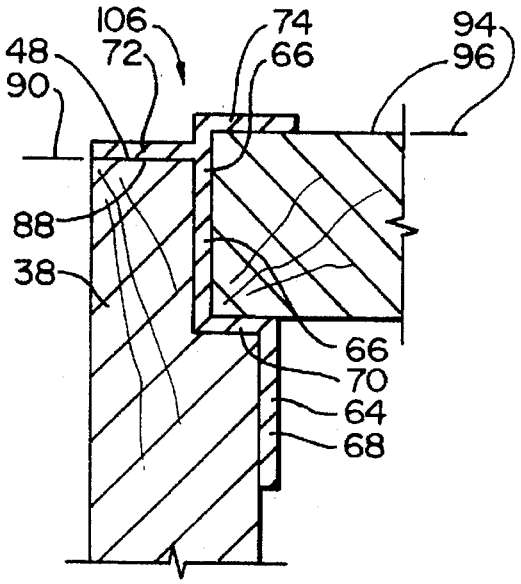
FIG. 5 is a cross-sectional view of a door installation apparatus according to a second embodiment of the invention, as would be viewed along lines 3—3 in FIG. 1.

FIG. 5—second embodiment

Referring to FIG. 5, an apparatus according to a second embodiment of the invention is shown generally at 106. In this embodiment, the body 64 still includes the door edge connecting portion 66, the frame connecting portion 68, the right angled portion 70, the frame alignment portion 72 and the door alignment portion 74 however the frame alignment plane 90 and the door alignment plane 94 are no longer coincident. Hence, the frame alignment surface 88 is at a different, pre-defined position with respect to the door edge connecting portion. In this embodiment therefore the door alignment portion 74 projects outwardly of the inside facing planar surface 48 of the frame member 38. An apparatus of this type is useful where it is desired that the inner surface 96 of the door projects outwardly of the inside facing planar surface 48 of the frame.

Figure 6:
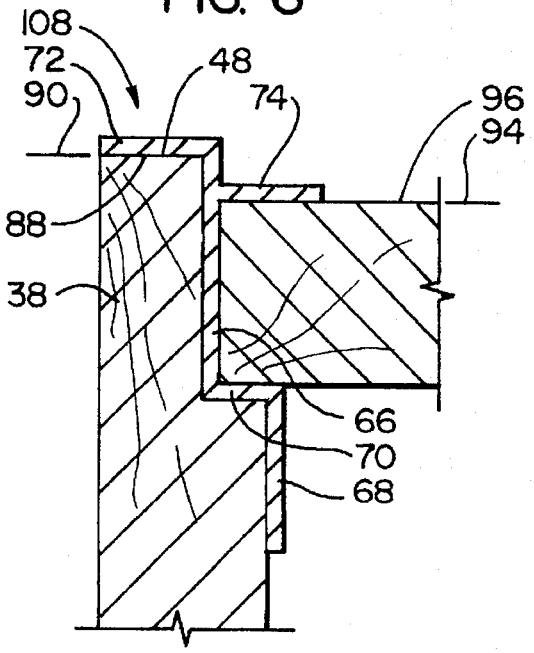
FIG. 6 is a cross-sectional view of a door installation apparatus according to a third embodiment of the invention, as would be viewed along lines 3—3 in FIG. 1.

FIG. 6—third embodiment

Referring to FIG. 6, an apparatus according to a third embodiment of the invention is shown generally at 108. This apparatus is generally the same as the apparatus shown in FIG. 5 with the exception that the frame alignment portion 72 projects outwardly of the door alignment portion 74 such that the frame alignment plane 90 and the door alignment plane 94 are no longer coincident. Hence, the frame alignment surface 88 is at yet another different pre-defined position with respect to the door edge connecting portion. In this embodiment, the inner surface 96 of the door is disposed inwardly of the inside facing planar surface 48 of the frame member 38. An apparatus of this type is useful where the inner surface of the door 96 is required to be inset from the inside facing planar surface 48.

Figure 7:
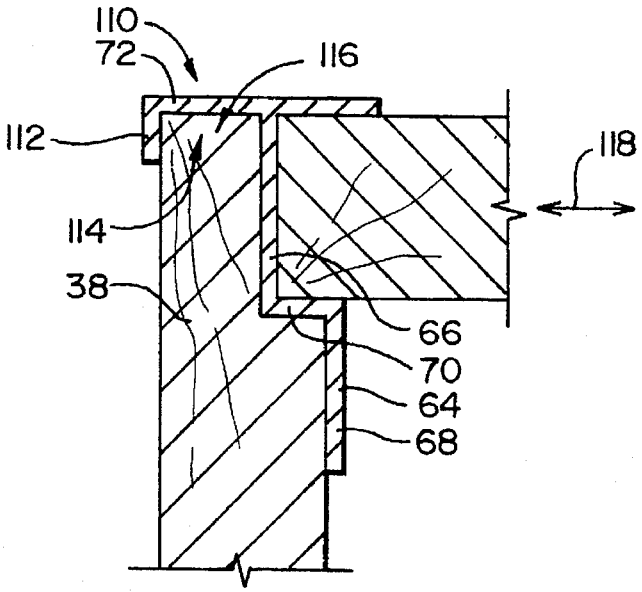
FIG. 7 is a cross-sectional view of a door installation apparatus according to a fourth embodiment of the invention, as would be viewed along lines 3—3 in FIG. 1.

FIG. 7—fourth embodiment

Referring to FIG. 7, an apparatus according to a fourth embodiment is shown generally at 110. The apparatus according to this embodiment is generally the same as the apparatus according to the first embodiment shown in FIGS. 1 through 3 with the exception of a parallel lip portion 112 which is connected to the frame alignment portion 72 and which extends parallel to the door edge connecting portion 66. The lip portion 112 forms a second channel portion 114 for receiving an inside facing portion shown generally at 116, of the frame member 38. An apparatus according to this embodiment is useful where the door unit is so large that there is some degree of movement of the door relative to the frame, in the direction of arrow 118. The parallel lip portion 112 helps prevent excessive movement in the indicated direction, when the body 64 is secured to the door and door frame.

Figure 8:
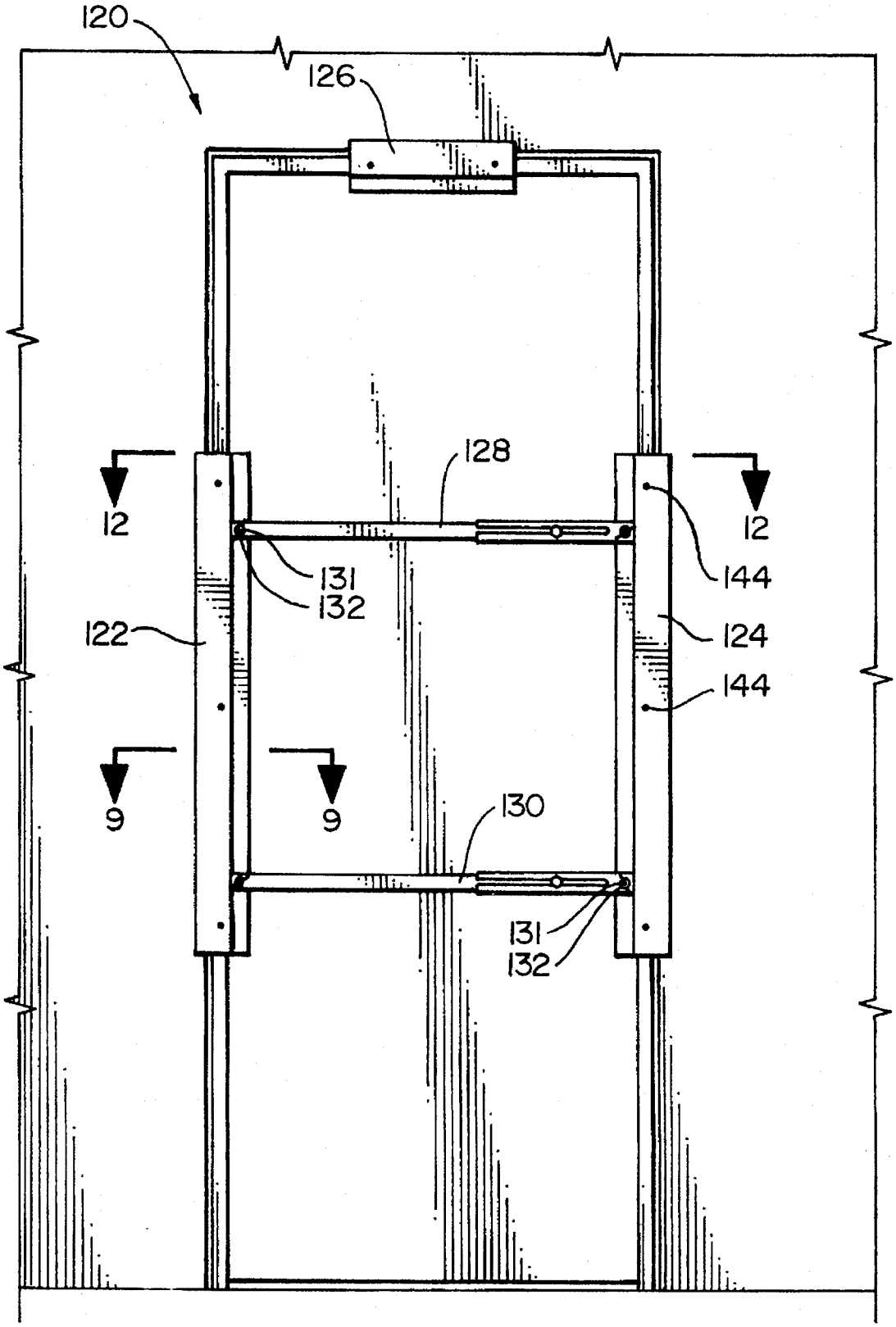
FIG. 8 is a front view of a first embodiment of an additional door installation apparatus for use in conjunction with the apparatus described in FIGS. 1–7.

FIG. 8—additional door installation apparatus: first embodiment

Referring to FIG. 8, an additional apparatus for use in conjunction with the apparatuses described in FIGS. 1 through 7, for installing a pre-hung door unit in a door opening, is shown generally at 120. The apparatus includes first and second side members 122 and 124 and a top member 126. Extending between the first and second side members 122 and 124 are first and second extendable and retractable cross members 128 and 130 respectively. The cross members 128 and 130 are removably connected to the first and second side members 122 and 124 by bolts 131 and wing nuts 132. The first and second side members 122 and 124, the top member 126 and the first and second cross members 128 and 130 are all disposed on an outside area of the pre-hung door unit and therefore are accessible from outside the room with which the door is associated.

FIG. 9—side member

Figure 9:
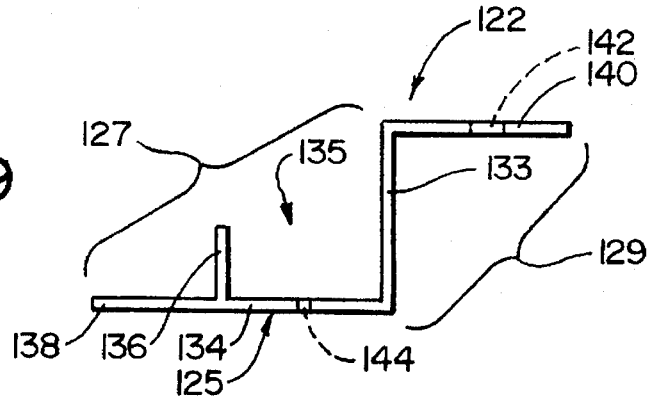
FIG. 9 is a cross sectional view of a first side member of the door installation apparatus shown in FIG. 8.

Referring to FIG. 9, the first side member 122 is formed from extruded aluminum into a body 125 having a frame connecting portion shown generally at 127 and a cross member connecting portion shown generally at 129. The frame connecting portion 127 is comprised of a channel portion shown generally at 135 formed from an inwardly facing surface contacting portion 133, an inside facing surface contacting portion 134, and a parallel web portion 136. A projecting portion 138 extends outwardly from the parallel web portion 136. The inside facing surface contacting portion 134 also has at least one opening 144 for receiving a double headed nail (not shown) therethrough for securing the body 125 to the frame.

The cross member connecting portion 129 includes a support portion 140 and the inwardly facing surface contacting portion 133. The support portion 140 has an opening 142 for receiving the bolt 131 shown in FIG. 8, therethrough.

The first and second cross members 128 and 138 are generally the same and therefore only the first cross member will be described.

Figure 10:
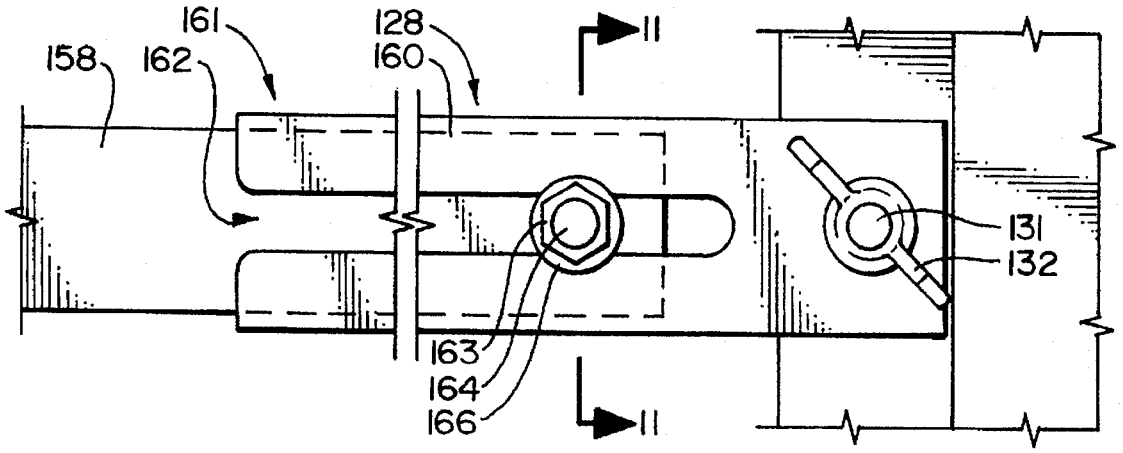
FIG. 10 is a broken side view of a first cross member of the additional apparatus shown in FIGS. 8–10.

FIG. 10—cross member

Referring to FIG. 10, the first cross member 128 has a telescoping portion comprised of first and second sliding members 158 and 160.

Figure 11:
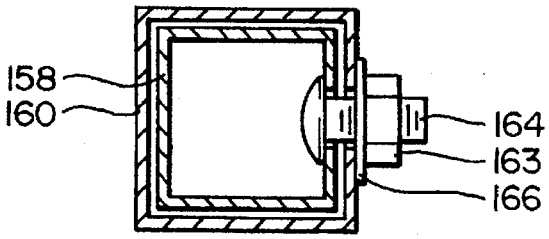
FIG. 11 is a cross sectional view of the first cross member as would be viewed along lines 11—11 of FIG. 10.

FIGS. 10 and 11—cross member

Referring to FIGS. 10 and 11, the first sliding member 158 is rectangular in cross section and has a smaller outer perimeter than the second sliding member 160 which thereby permits the first sliding member 158 to slide and be guided in sliding movement by member 160. Member 160 is formed with a slot 162 and member 158 has a nut 163, bolt 164 and washer 166. The bolt 164 is suitably dimensioned to prevent interference with the slot 162 and the washer 166 is of sufficient diameter to prevent the washer 166 from sliding into the slot 162. It will be appreciated that member 158 can slide with respect to member 160 and that the nut 163 can be tightened when the member 158 and 160 are at any desired degrees of extension or retraction to thereby secure member 158 to member 160. This permits the cross member 128 to be extended or retracted to suit the particular spacing between frame members 146 and 152 as may be required with different sized door units.

Operation

FIG. 12

Figure 12:
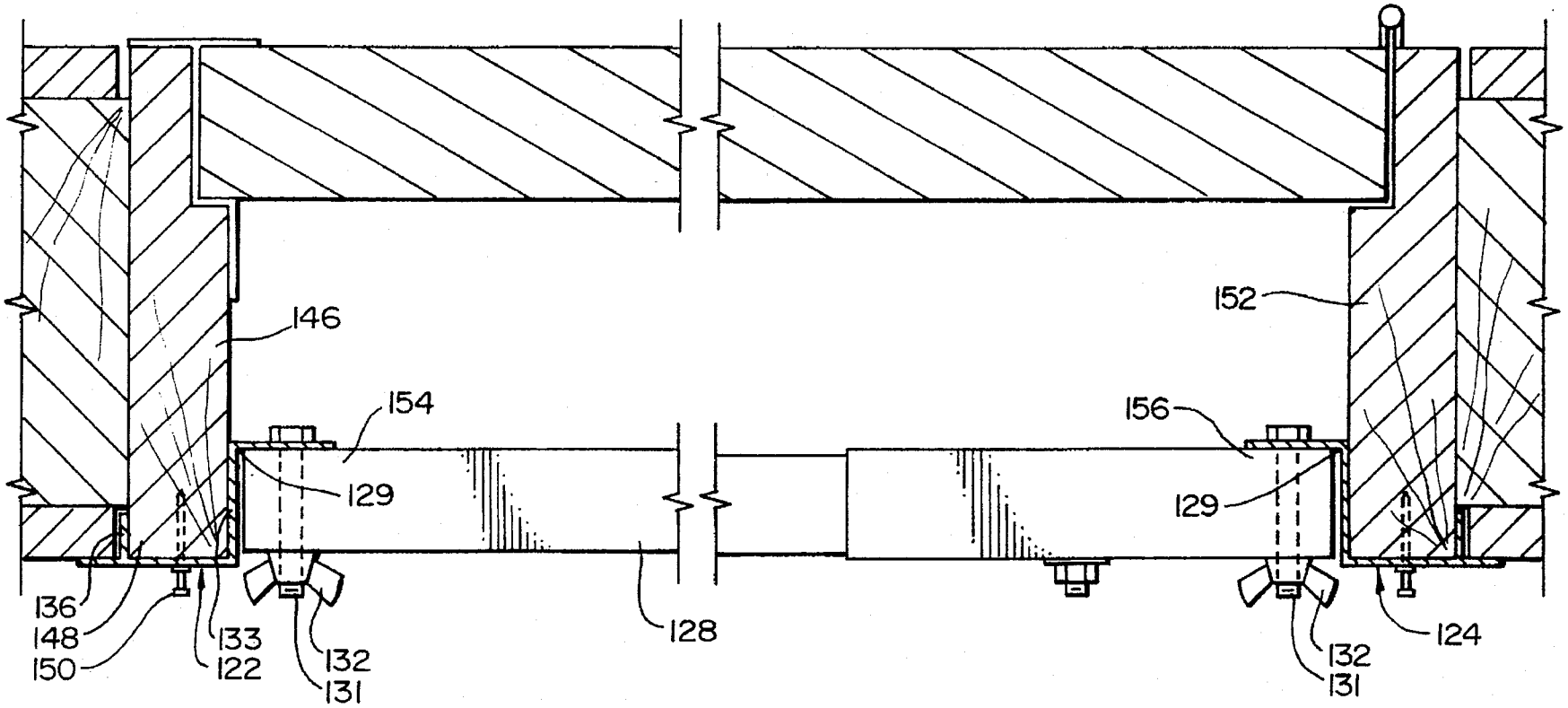
FIG. 12 is a cross sectional view of a pre-hung door unit employing both the apparatus of FIGS. 1–7 and the apparatus of FIGS. 8–11, as would be viewed along lines 12—12 in FIG. 8.

Referring to FIG. 12, the first side member 122 is secured to a left-hand side frame member 142 of the door unit such that a portion 148 of the frame member is received between the inwardly facing surface contacting portion 133 and the parallel web portion 136. Double headed nails 150 are inserted through respective openings 144 and are hammered into the left-hand side frame member 146 to secure the first side member 122 thereto. A similar procedure is followed for a right-hand frame member 152 of the door unit.

The first cross member 128 is then secured to the first and second side members 122 and 124 by first extending the cross member 128 until opposite end portions 154 and 156 thereof are received in respective cross member connecting portions 129 and then securing the end portions 154 and 156 to the cross member connecting portions with bolts 131 and wing nuts 132. The first cross member 128 is thus rigidly connected to the first and second side members 122 and 124. Referring back to FIG. 8, a similar procedure is followed to secure the second cross member 130 to the first and second side members 122 and 124.

The first and second cross members 128 and 130 are rigidly secured to the first and second side members 122 and 124 in parallel spaced apart relation. This enables a workman to grasp the first and second cross members 128 and 130 to lift the door unit for the purposes of transporting it to the job site and to manipulate the door unit into position within the opening in the wall. Since the first and second side members 122 and 124, first and second cross members 128 and 130 and top member 126 are all installed on an outside portion of the door unit, the installer may manipulate the door into position from outside the room. Furthermore, after the door unit is in place and nailed to the wall studs (not shown), the first and second cross members 128 and 130 may be removed, the first, second and top members 122, 124 and 126 may be removed and the door installation apparatuses 59 and 61 as described in FIGS. 1–7 may be removed, all from the outside of the room. The task of installing a pre-hung door is thus simplified as the prior need to walk around the house to gain access to the door unit during installation, and the prior need to employ two installers to install a door unit is eliminated.

Figure 13:
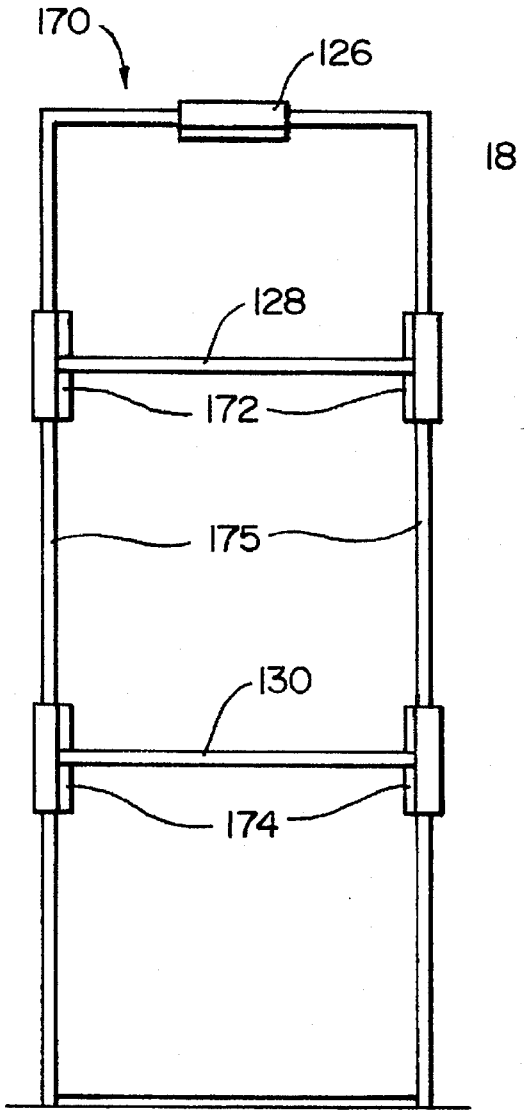
FIG. 13 is a front view of an additional apparatus according to a second embodiment of the invention.

FIG. 13—second embodiment of additional apparatus

Referring to FIG. 13, a second embodiment of the apparatus shown in FIGS. 8–12 is shown generally at 170. Generally, this embodiment is the same as the embodiment shown in FIGS. 8–12 with the exception that the first and second cross members 128 and 130 are connected to separate pairs 172 and 174 of side members. This embodiment may be convenient where access to central portions 175 of the frame is required.

Figure 14:
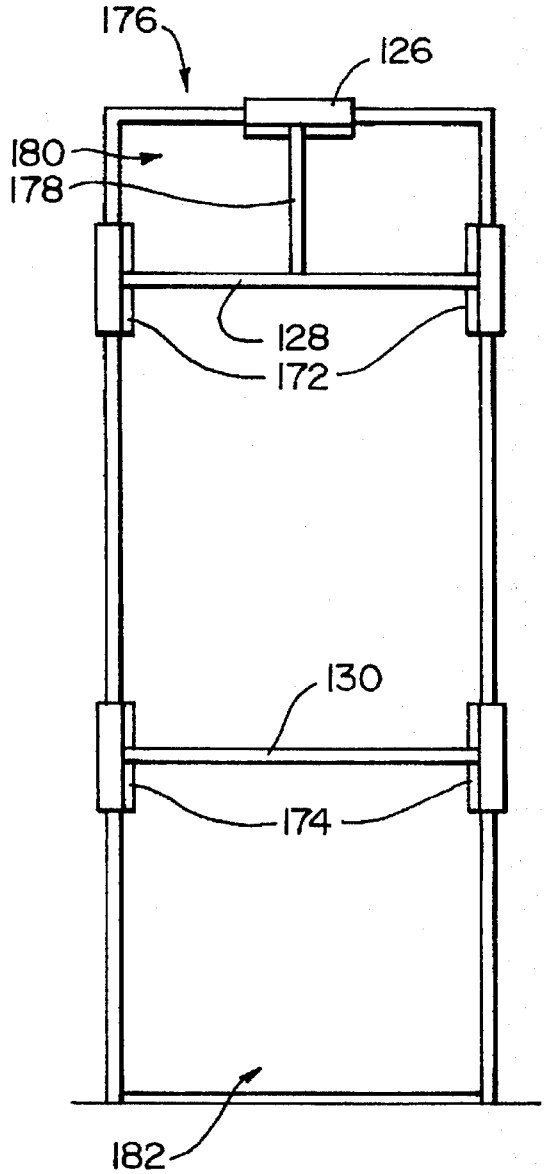
FIG. 14 is a front view of an additional apparatus according to a third embodiment of the invention.

FIG. 14—third embodiment of additional apparatus

Referring to FIG. 14, a third embodiment of the apparatus shown in FIGS. 8–12 is shown generally at 176. This embodiment is generally the same as the embodiment shown in FIGS. 13 with the exception that the first cross member 128 is connected by a brace member 178 to the top member 126. This embodiment may be convenient where a top portion 180 of the door unit is heavier than a lower portion 182 thereof.

FIG. 15—fourth embodiment of additional apparatus

Referring to FIG. 15, a fourth embodiment of the apparatus of FIG. 8 is shown generally at 184. In this embodiment, the first and second side members 122 and 124 and top member 126 include respective flat surface portions 186, 188 and 190, each of the flat surface portions having inwardly extending connecting portions 192, 194 and 196 respectively and outwardly extending alignment portions 191, 193 and 195 respectively. Each of the connecting portions has openings (not shown in FIG. 15) for receiving bolts depicted generally at 198 for securing first and second cross members 200 and 201 thereto. The alignment portions extend outwardly of the frame and contact an outer surface of the finished wall. This serves to align the edges of the door frame with the finished wall as shown in FIG. 16.

FIG. 16

Referring to FIG. 16, side member 122 has first and second parallel channel portions 202 and 208 which are spaced apart to receive a portion 210 of the door frame. The first and second channel portions 202 and 208 prevent horizontal movement of the member 122 in the direction of arrow 212. Double headed nails such as shown at 214 are used to secure the member 122 to the frame portion 210. The connecting portion 192 has first and second shoulder portions 216 and 218 which are spaced apart sufficiently to receive a bolt head 220 therebetween but not so far apart as to permit the bolt head to rotate during tightening of the bolt.

Referring back to FIG. 15, the first and second cross members 200 and 201 are generally similar and therefore only the first cross member 200 will be described. The first cross member includes a rigid, round member 221 having first and second opposite connecting portions 222 and 224 for use in connecting the cross member to the first and second side members 122 and 124 respectively.

FIG. 17

Referring to FIG. 17, the first connecting portion 222 is shown. The first connecting portion includes a flat plate member 226 having a plurality of pairs of spaced apart openings, one of which is depicted generally at 228. In this embodiment, each pair of openings 228 is spaced apart from an adjacent pair by two inches which permits the connection of the plate member 226 to the first (or second) side members 122 and 124 to be adjusted in two-inch increments. Thus the apparatus according to this embodiment is discretely adjustable to define predefined spacings between openings on the first and second connecting portions hence the apparatus may be used to precisely set the distance between first and second parallel upstanding frame members. By providing such discretely defined spacing, the door frame is maintained perfectly square during transportation and installation of the pre-hung door unit and therefore eliminates skewing of the door frame as experienced with conventional installation methods practised to date.

Figure 18:
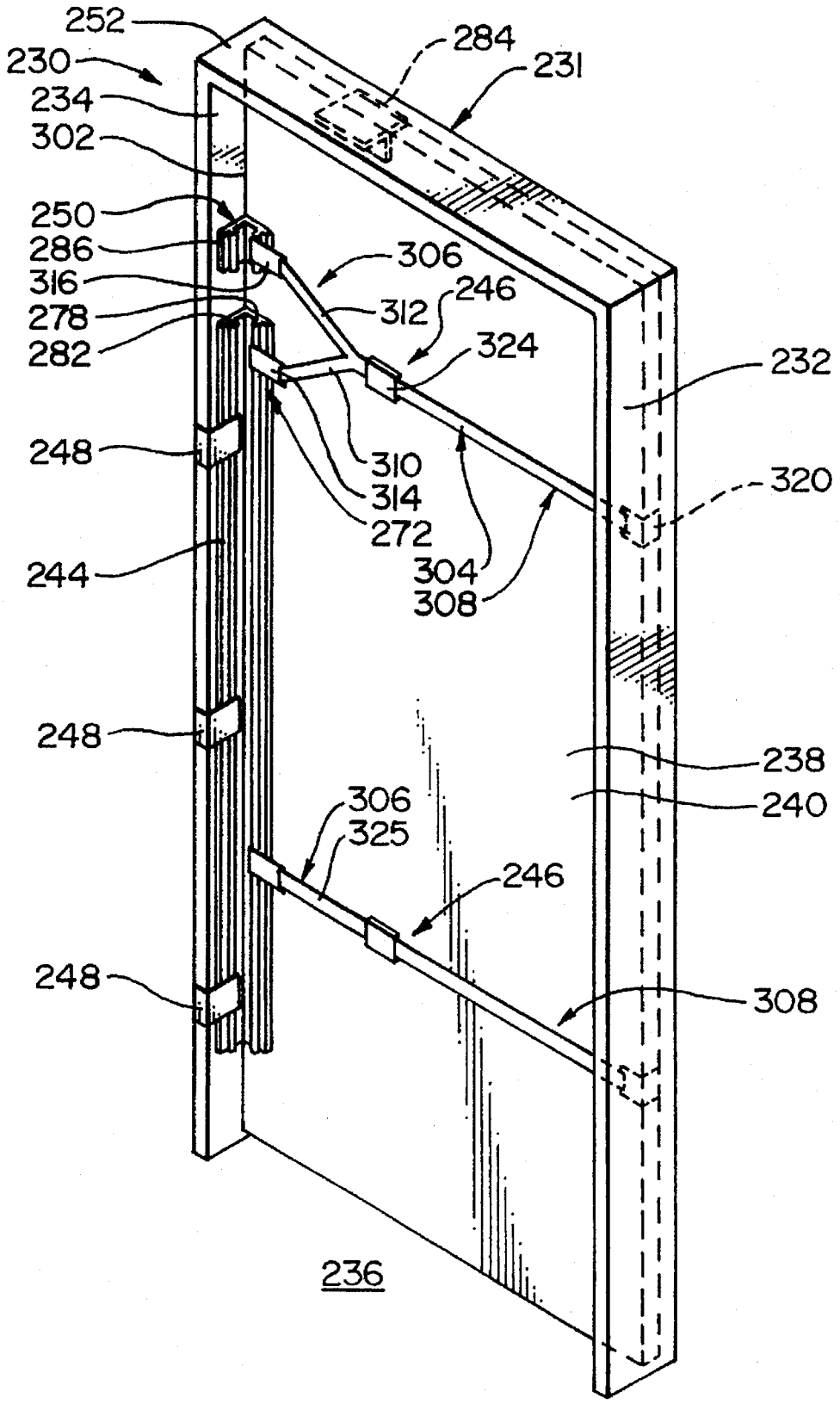
FIG. 18 is a broken perspective view of a pre-hung door according to a fifth embodiment of the invention, viewed from outside a room in which the door unit is installed.
Figure 19:
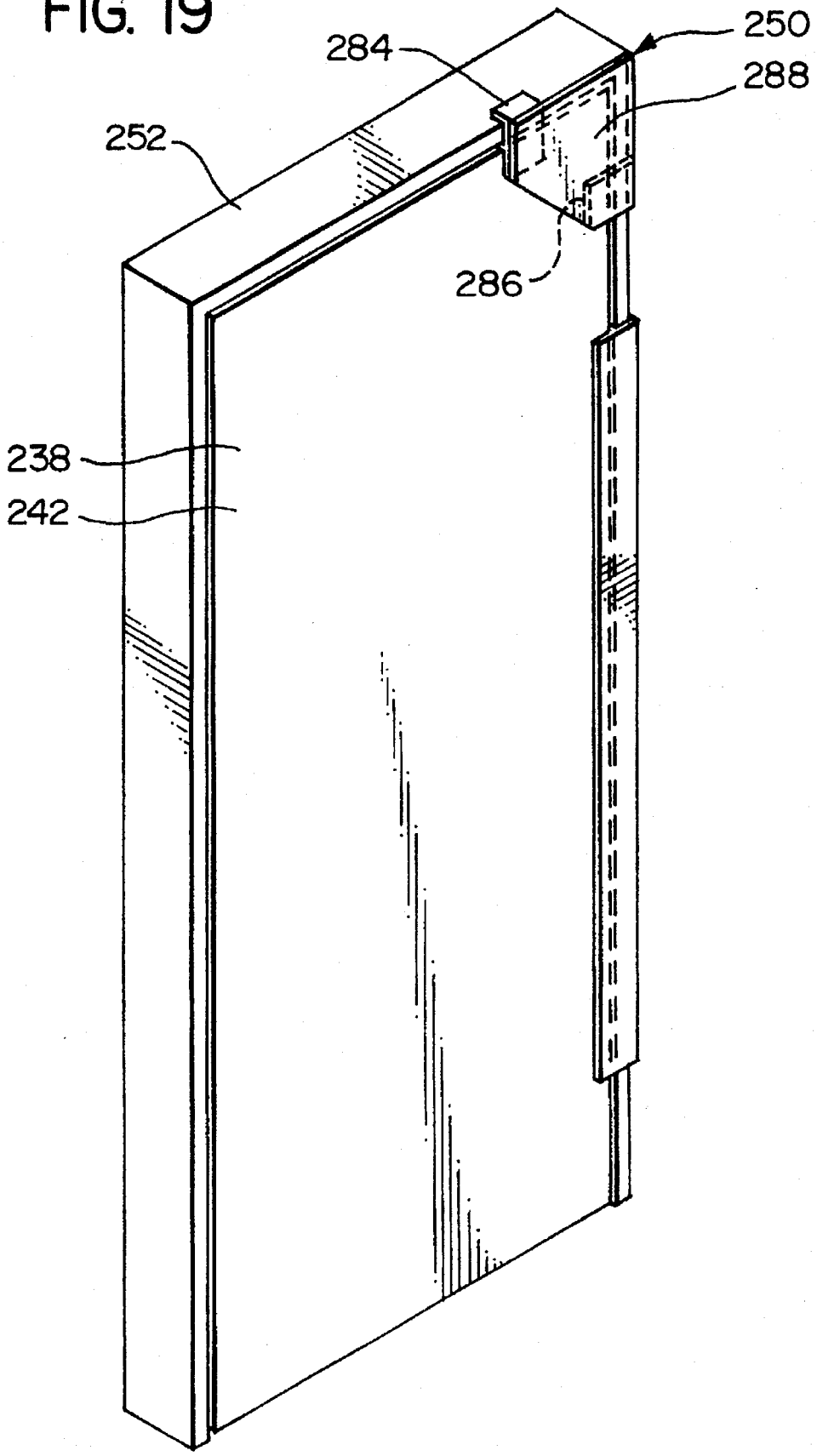
FIG. 19 is a perspective view of the door unit of FIG. 18 viewed from inside the room.

FIGS. 18 and 19—fifth embodiment of body

Referring to FIG. 18, an apparatus for installing a pre-hung door unit, according to fifth embodiment of the invention is shown generally at 230. As in previous embodiments, the pre-hung door unit 231 includes a door frame 232 having an inwardly facing portion 234 accessible from an outside facing side 236 of the door unit 231 and a door 238 hingedly connected to the door frame 232. The door 238 has an outwardly facing surface 240 and has an inwardly facing surface 242 shown best in FIG. 19.

Body

Referring back to FIG. 18, the apparatus includes a body 244 which is secured to the door 238 and door frame 232 by respective pluralities of door and frame retaining members, the door retaining members shown extending across the door at 246 and the frame retaining members shown extending across the frame at 248, respectively. Referring to FIG. 19, also included in this embodiment is a door corner alignment member 250 which facilitates alignment of the door 238 with a top portion 252 of the frame 232.

FIG. 20

Figure 20:
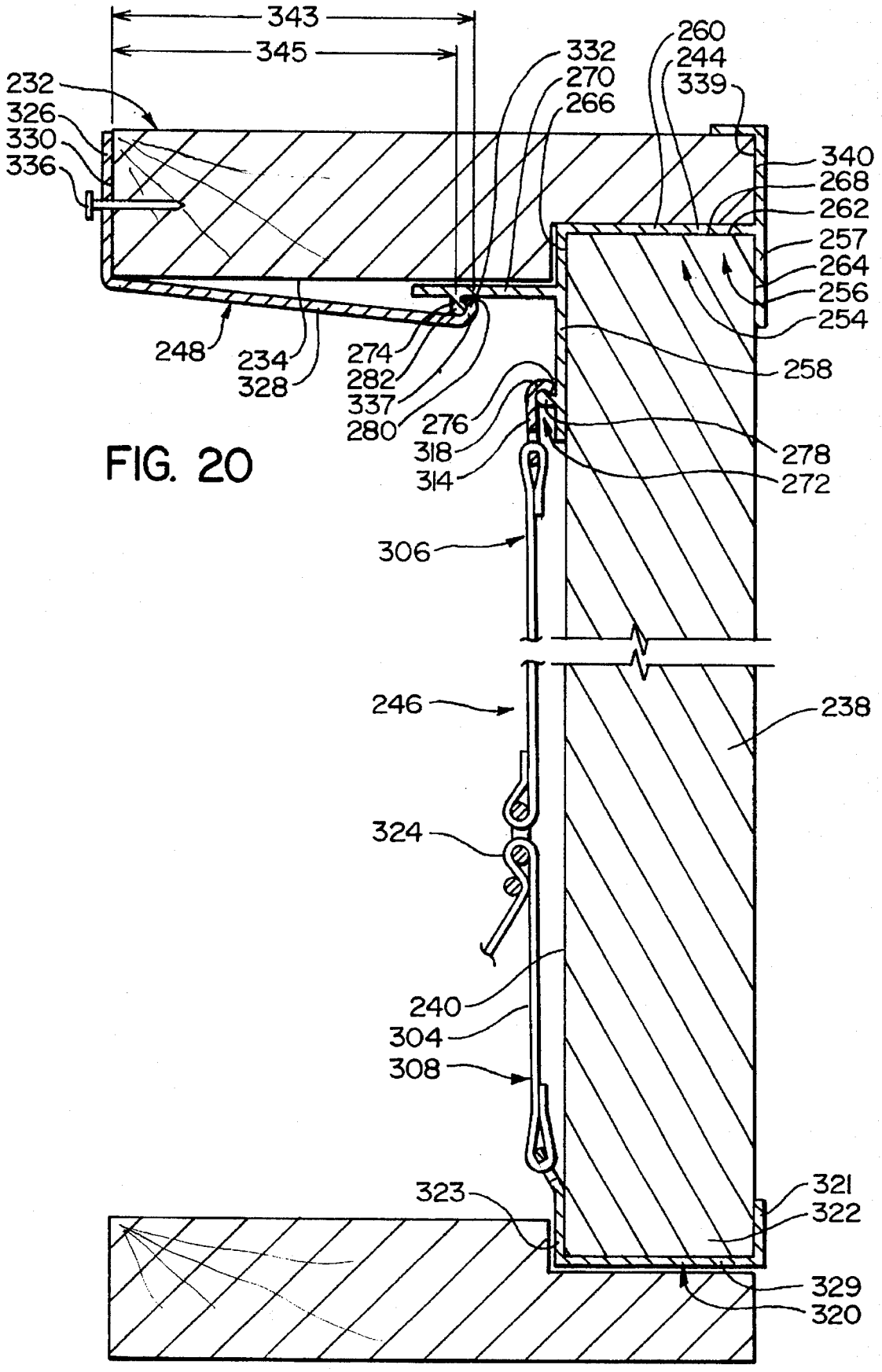
FIG. 20 is a plan view of an apparatus according to a fifth alternative embodiment of the invention.

Referring to FIG. 20, the body 244 has a door connecting portion 254 including a channel portion 256 formed therein, the channel portion 256 including first and second parallel upstanding side portions 257 and 258 connected together by a door edge connecting portion 260. A side edge portion 262 of the door is received between the first and second parallel upstanding side portions 257 and 258 such that an inner surface 264 and an outer surface 266 of the side edge portion 262 are closely adjacent the first and second parallel upstanding portions, and such that an edge surface 268 of the door edge portion contacts the door edge connecting portion 260.

The body 244 also has a frame connecting portion 270 connected to the second upstanding side portion 258 to extend generally at a right angle relative thereto, the frame connecting portion 270 being positioned on the inwardly facing portion 234 of the frame when the apparatus is installed.

In this embodiment however, the door connecting portion 254 further includes a door connector 272 for cooperating with the first door retaining member 246 to retain the body 244 against the side edge portion 262 and includes a frame connector 274 for cooperating with frame retainer 248 for retaining the body 244 against the door frame 232.

Door connector

Still referring to FIG. 20, the door connector 272 is disposed on the second upstanding side portion 258 and includes a first receptacle 276 for receiving and holding the first door retaining member 246. The first receptacle 276 is formed by a first circular cross-sectioned projection 278 extending longitudinally along the entire length of the body as shown in FIG 18. The first projection 278 extends outwardly of the second upstanding side portion 258 and the first receptacle 276 is formed between a portion of the first projection 278 and the second upstanding portion 258.

Frame connector

Still referring to FIG. 20, the frame connector 274 includes a second receptacle 280 for receiving and holding the frame retainer 248. The second receptacle 280 is formed by a second projection 282 extending longitudinally along the body, seen best in FIG. 18. Referring back to FIG. 20, the second projection 282 extends outwardly of the frame connecting portion 270 and the second receptacle 280 is formed between a portion of the second projection 282 and the frame connecting portion 270.

FIG. 21

Corner alignment member

Figure 21:
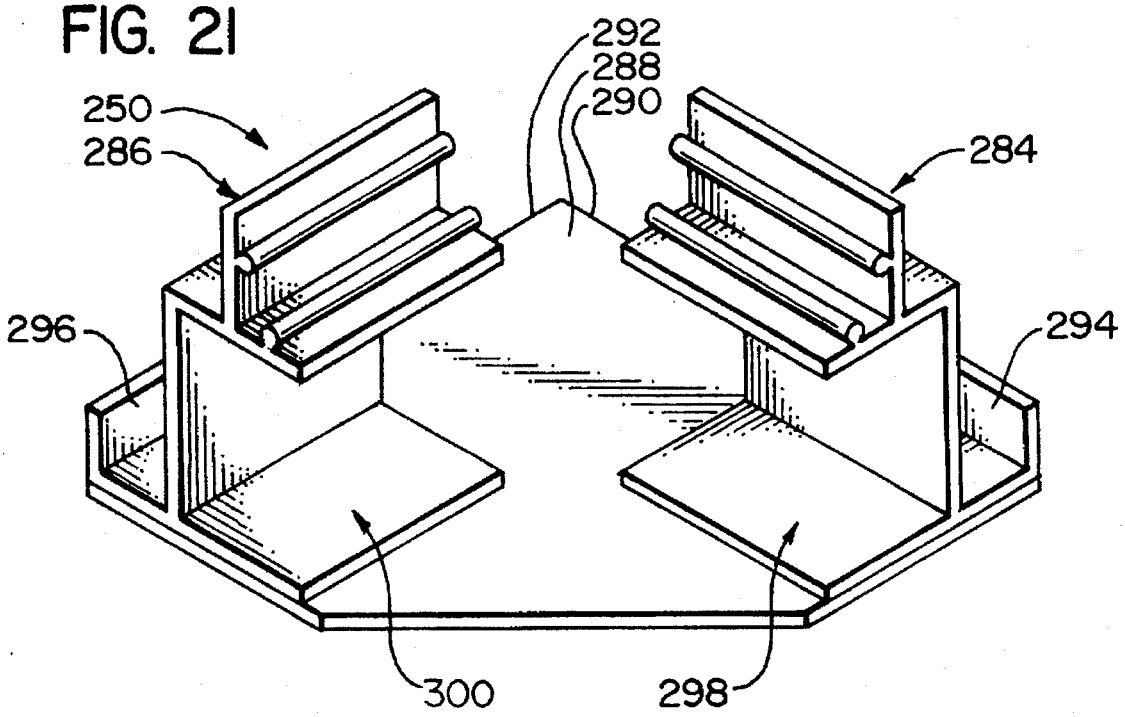
FIG. 21 is a perspective view of a corner alignment member according to the fifth embodiment of the invention.

Referring to FIG. 21, the corner alignment member 250 is shown in more detail. The corner alignment member includes first and second similar body portions 284 and 286 disposed at right angles to each other and secured to a backing plate 288. The backing plate has first and second straight edges 290, 292 disposed at right angles to each other. The first and second body portions 284 and 286 have respective planar lip portions 294 and 296 and are secured as by rivets or spot welding to the backing plate such that the first and second lip portions 294 and 296 are coplanar with the first and second straight edges 290, 292 respectively. This also positions respective channel portions 298, 300 of the first and second bodies at right angles to each other such that they are operable to grip top and side edge portions respectively of the door as shown in FIG. 19.

Door Retainer

Referring to FIG. 18, a representative door retaining member 246 is operable to simultaneously retain the main body 244 against the side edge portion 262 of the door and maintain the first body portion 284 of the corner alignment member 250 against an upper side edge portion 302 of the door 238. The door retaining member 246 includes a first flexible tension member 304 having first and second end portions 306 and 308. In this embodiment, the first end portion 306 includes first and second branches 310 and 312, each branch being terminated in a respective clip 314 and 316 for cooperating with and connecting to the door connectors 272 on the main body 244 and the second body portion 286 of the corner alignment member 250 respectively. Each clip 314 and 316 includes a respective first hook portion. The first hook portion on clip 314 is shown in FIG. 20 at 318. The hook portion cooperates with the first receptacle 276 to secure the clip 314 to the main body 244 when the first flexible tension member 304 is tensioned. Clip 316 shown in FIG. 18 functions in a similar manner.

Referring to FIG. 20, the second end portion 308 has a door hook member 320 for connecting to a hinge edge 322 of the door 238 to secure the first flexible tension member 304 thereto. The door hook member 320 has first and second spaced apart parallel upstanding portions 321 and 323 connected together by a door cooperating portion 329. The first and second upstanding portions are operable to extend on opposite sides of the door, while the door cooperating portion extends transversely across the hinge edge 322 of the door. The door hook member 320 is securely held on the hinge edge when the first flexible tension member 304 is tensioned.

The first flexible tension member 304 includes a first tensioner 324 for tensioning the first flexible tension member to draw the first and second end portions 306 and 308 together, thereby urging the main body 244 and the door hook member 320 against respective opposite door edges.

Referring to FIG. 18, the remaining first retainer shown extending across a lower portion of the door is similar but has only one branch 325 on the first end portion 306.

Frame retainer

Referring to FIG. 20, the frame retainer 248 is for retaining the body 244 against the inwardly facing portion 234 of the door frame 232. The frame retainer has a door frame cooperating portion 326 and a body connector portion 328 for connecting the second tension member to the frame connector 274 on the body. The door frame cooperating portion 326 and the body connector portion 328 are disposed at an approximately 90 degree angle relative to each other such that the door frame cooperating portion 326 is operable to contact an outwardly facing surface 330 of the door frame 232 while the body connector portion 328 extends along the inwardly facing portion 234 of the door frame 232. The body connector portion 328 includes an interfering projection 332 including a curved projecting portion 337 operable to engage the second receptacle. The frame connector 274 resists any tendency of the curved projecting portion 337 to come free. It will be appreciated that the distance 343 between the door frame cooperating portion 326 and the interfering projection must be accurately determined to be approximately the distance 345 between the frame connector 274 and the outwardly facing surface 330 of the door frame 232 such that the frame retainer can be connected to the frame connector 274 and rotated against the outwardly facing surface 330 of the door such that a wedge action is created as the door frame cooperating portion 326 contacts the outwardly facing surface 330 to keep the frame retainer 248 in place. The frame retainer is then secured in place by a nail 336.

With the frame retainer in place, the door frame 232 is squeezed between the body 244 and the door frame cooperating portion 326 to hold the body 244 against the door frame.

Operation

Referring to FIG. 20, to use the apparatus, with the door 238 open, the body 244 is placed on the side edge portion 262 as described in connection with the preceding embodiments. The corner alignment member 250 is then placed on an upper corner portion of the door as shown in FIG. 18 and 19.

Next, still with the door 238 open, the door hook member 320 is engaged with the hinge edge 322 of the door and the first flexible tension member 304 is laid along the outwardly facing surface 240 such that the first flexible tension member 304 extends transversely across the outside facing surface. The first and second clips 314 (and 316) are then engaged with the first receptacles 276 of the main body 244 and of the second body on the corner alignment member as shown in FIG. 18. The first tensioner 324 is then used to tension the first flexible tension member 304 such that the door hook member 320 and the body 244 are urged against respective edge surfaces of the door.

Referring to FIG. 20, the door 238 is then closed until a frame alignment surface 339 of the body 244 contacts an inside facing planar frame surface 340. The frame retainer 248 is then oriented to engage the curved projection 337 with the second receptacle 280 and the frame retainer is then rotated to engage the door frame cooperating portion 326 with the outwardly facing surface 330 of the frame 232, whereupon a wedge effect is created by the action of the angularly disposed frame cooperating portion 326 on the outwardly facing surface 330 of the door frame 232, which holds the frame retainer thereon. The nail 336 is then driven through the door frame cooperating portion 326 to secure the frame retainer to the door frame 232. The frame retainer is prevented from release from the body by cooperation between the curved projecting portion 337 and the receptacle 280 and therefore is securely but releasably held to the body 244.

The door frame 232 is then ready to be nailed in place, after which the frame retainer 248 may be released from the door frame by removing the nail 336 and prying the door frame cooperating portion 326 from the door frame 232 and then rotating the frame retainer 248 to disengage the curved projecting portion 337 from the second receptacle 280 to permit the frame retainer to be released from the body 244. The first strap tensioner 324 may then be released to release the tension in first flexible tension member 304 to permit the clip 314 (and clip 316) and the door hook member 320 to be removed from the main body 244 and hinge edge 322 respectively, thereby freeing the body 244 from the side edge portion 262. The door 238 may then be opened and closed in the usual manner.

FIG. 22

Figure 22:
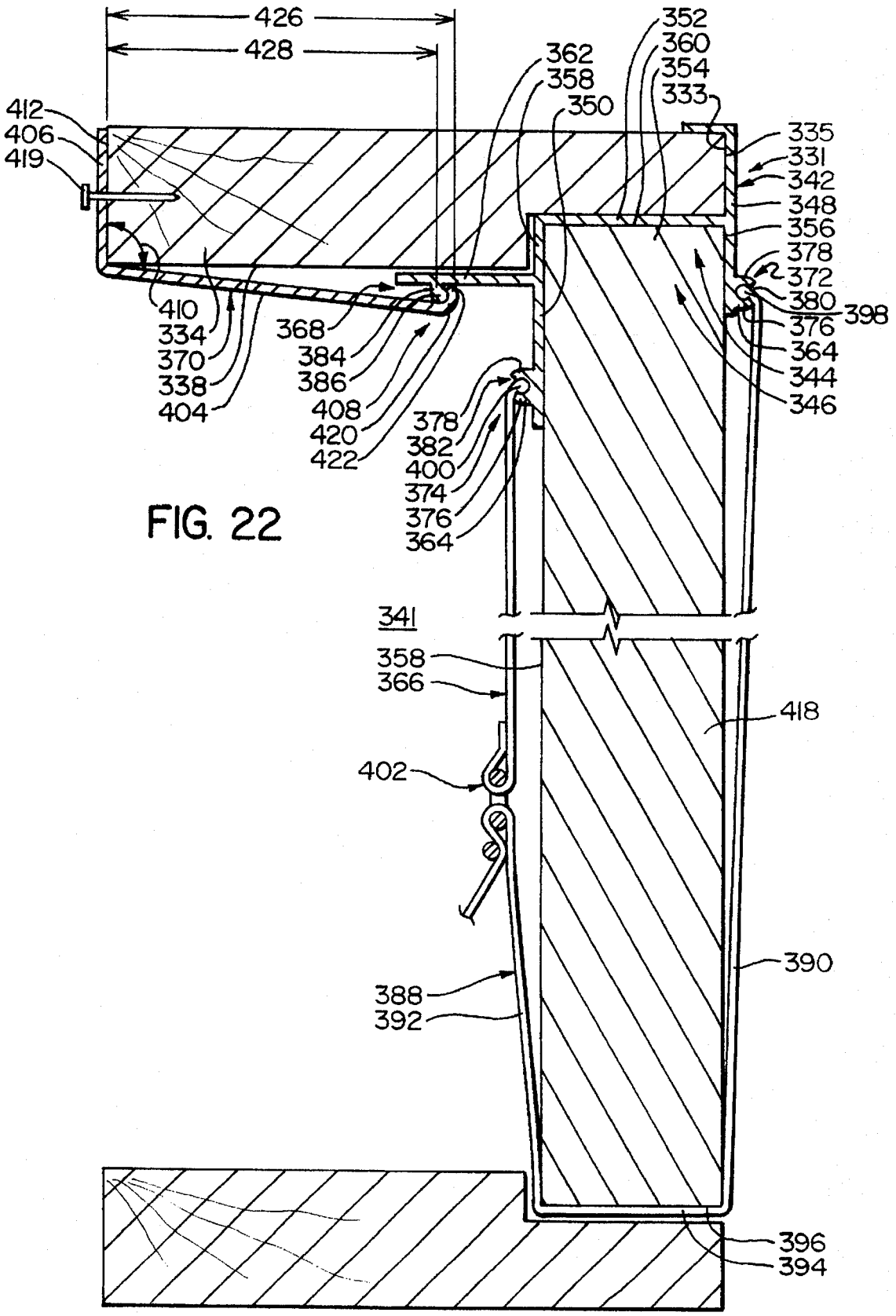
FIG. 22 view of an apparatus according to a sixth alternative embodiment of the invention.

Referring to FIG. 22, an apparatus for installing a pre-hung door unit, according to a sixth embodiment of the invention is shown generally at 331.

As in the previous embodiments, the pre-hung door unit includes a door frame 334 having an inwardly facing portion 338 accessible from an outside facing side 341 of the door unit and a door 418 hingedly connected to the door frame 334. The apparatus includes a body 342 having a door connecting portion 344 including a channel portion 346 formed therein, the channel portion 346 including first and second parallel upstanding side portions 348 and 350 connected together by a door edge connecting portion 352. The door edge portion 354 is received between the first and second parallel upstanding side portions 348 and 350 such that an inner surface 356 and an outer surface 358 of the door edge portion 354 are closely adjacent the first and second parallel upstanding portions, and such that an edge surface 360 of the door edge portion 354 contacts the door edge connecting portion 352. In addition, the body 342 has a frame connecting portion 362 connected to the second upstanding side portion 350 to extend generally at a right angle relative thereto, the frame connecting portion 362 being positioned on the inwardly facing portion 338 of the frame 334 when the apparatus is installed.

In this embodiment however, the door connecting portion 344 further includes a door connector, shown generally at 364, for cooperating with a first retainer 366 for retaining the body 342 against the door edge portion 354 and includes a frame connector 368 for cooperating with a frame retainer 370 for retaining the body 342 against the door frame 334.

The door connector 364 includes first and second connectors 372 and 374 disposed on the first and second upstanding side portions 348 and 330 respectively. The first and second connectors include respective first and second arcuate portions 376 and 378 defining first and second cylindrical receptacle openings 380 and 382 respectively for receiving and holding respective portions of the first retainer 366.

The frame connector 365 includes a web member 384 extending from the frame connecting portion 362 and a bead portion 386 on the web member. The first and second arcuate portions 376 and 378 and the web member 384 and bead portion 386 are formed in the body 342 at the time of manufacture, by extrusion.

The first retainer 366 is for retaining the body 342 against the edge portion of the door 418 and includes a first web tension member 388 having first and second tensionable portions 390 and 392 and a door cooperating portion 394 between the first and second tensionable portions 390 and 392. The door cooperating portion 394 is operable to engage a hinge edge 396 of the door 418 and the first and second tensionable portions 390 and 392 have first and second cylindrical connector portions 398 and 400 respectively which are operable to be received in the first and second cylindrical receptacle openings 380 and 382 respectively. Thus the first and second tensionable portions 390 and 392 are operable to connect to the body 342.

The second tensionable portion 392 is fitted with a conventional strap tightener 402 which allows the first and second tensionable portions 390 and 392 to be tensioned to cause the door 418 to be squeezed between the body 342 and the door cooperating portion 394. This retains the body 342 against the door edge portion 354 and urges the body 342 thereagainst.

The frame retainer 370 is for retaining the body 342 against the inwardly facing portion 338 of the door frame 334 and includes a second tension member 404. The second tension member 404 has a door frame cooperating portion 406 and a third connector portion 408 for connecting the second tension member 404 to the frame connector 368 on the body 342. The door frame cooperating portion 406 and the third connector portion 408 are disposed at an approximately 90 degree angle 404 relative to each other such that the door frame cooperating portion 406 is operable to contact an outwardly facing surface 412 of the door frame 334 while the third connector portion 408 extends along the inwardly facing portion 338 of the door frame 334. The third connector portion 408 includes an interfering projection 420 including a curved projecting portion 422 operable to hook onto the web member 384. The bead portion 386 resists any tendency of the curved projecting portion 422 to come free of the web member, due to its larger size than the web member. It will be appreciated that the distance 426 between the door frame cooperating portion 406 and the interfering projection 420 must be accurately determined to be approximately the distance 428 between the web member 384 and the outwardly facing surface 412 of the door frame 334 such that the second tension member 404 can be connected to the frame connector 368 and rotated against the outwardly facing surface 412 of the door 418 such that a wedge action is created as the door frame cooperating portion 406 contacts the outwardly facing surface 412 to keep the second tension member 404 in place. A nail may be used to further secure the second tension member in place. With the second tension member 404 in place, the door frame 334 is squeezed between the body 342 and the door frame cooperating portion 406 to hold the body 342 against the door frame 334.

To use the apparatus, the body 342 is placed on the door edge portion 354 of the door 418 as described in connection with the preceding embodiments.

Next, the door 418 is opened and the first web tension member 388 is wrapped around the hinge edge 396 of the door 418 such that the first tensionable portion 390 extends transversely across the inner surface 356 while the second tensionable portion 392 extends across the outer surface 358 of the door 418 and the door cooperating portion 394 contacts the hinge edge 396 of the door. Preferably, the strap tightener 402 is disposed to cooperate with the second tensionable portion 392 such that the first web tension member 388 can be tensioned from the outside of the room.

Next, the first and second cylindrical connector portions 398 and 400 and are inserted and slid longitudinally (perpendicular to the plane of the drawing) in the first and second receptacle openings 380 and 382 respectively such that they are held securely therein. The strap tightener 402 is then tensioned such that the door 418 is squeezed between the body 342 and the door cooperating portion 394, whereby the body 342 is urged against the edge surface 360 of the door 418.

The door 418 is then closed until a frame alignment surface 333 of the body 342 contacts an inside facing planar surface 335 of the frame 334. The second tension member 404 is then oriented to engage the interfering projection 420 with the web member 384 and is then rotated to engage the door frame cooperating portion 406 with the outwardly facing surface 412 of the frame, whereupon a wedge effect is created by the action of the angularly disposed frame cooperating portion on the outwardly facing surface 412 of the frame member, which holds the second tension member 404 thereon. The nail 419 may be driven into the frame cooperating portion 406 to further secure the frame retainer to the frame. The second tension member 404 is prevented from release from the body 342 by the bead portion 386 and therefore is securely but releasably held to the body. Hence the second tension member 404 squeezes the door frame 334 between the body 342 and the door frame cooperating surface to hold the body 342 and urge the body 342 against the door frame 334.

The door frame 334 is then ready to be nailed in place, after which the second tension member 404 may be released from the door frame 334 by prying the door frame cooperating portion 406 from the door frame 334 and then rotating the second tension member 404 to disengage the interfering projection 420 from the web member 384 to permit the second tension member 404 to be released from the body 342. The strap tightener 402 may then be released to release the tension in first web tension member 388 to permit the first and second cylindrical connector portions 398 and 400 to be extracted from the first and second receptacle openings 380 and 382 respectively whereby the body 342 is released from the door edge portion 354. The door 418 may then be opened and the first web tension member 388 may be freed from the hinge edge 396 of the door.

The immediately preceding description relates only to one body 342 being attached to a door 418 for installation but it will be appreciated that a plurality of bodies may be used to secure the door 418 to the door frame 334, each having its own first retainer 366 and frame retainer 370. It will further be appreciated that the bodies are reusable.

While specific embodiments of the invention have been described and illustrated, such embodiments should be considered illustrative of the invention only and not as limiting the invention as construed in accordance with the accompanying claims.

What is claimed is:

1. An apparatus in combination with a pre-hung door unit including a door frame having an inwardly facing portion accessible from an outside facing side of the door unit and a door hingedly connected to the door frame, the apparatus comprising:

a) a body having:

i) door edge portion connecting means for removably connecting the body to an edge portion of the door, said door edge portion connecting means including a door edge connecting portion having a first surface for contacting an edge surface of the door; and ii) frame connecting means connected to the door edge portion connecting means, for removably connecting the body to an inwardly facing portion of the door frame, said frame connecting means including a frame connecting portion having a second surface operable to contact a surface of the inwardly facing portion of the door frame; and b) aligning means for aligning an inner planar surface of the door with an inside facing surface of the door frame such that said inner planar surface of the door and said inside facing surface of the door frame lie in parallel planes, the aligning means including a frame alignment portion, the frame alignment portion having a flat planar frame alignment surface for contacting said inside facing surface of the door frame, said flat planar frame alignment surface lying in a frame alignment plane and being located at a pre-defined alignment position with respect to the door edge portion connecting means, the aligning means further including a door alignment portion on the body, the door alignment portion having a door alignment surface lying in a door alignment plane, for contacting said inner planar surface of the door, the frame alignment plane and the door alignment plane being parallel to each other.

2. An apparatus as claimed in claim 1 wherein the first and second surfaces are flat planar surfaces lying in first and second parallel, spaced apart planes respectively.

3. An apparatus as claimed in claim 2 wherein the door edge connecting portion and frame connecting portion are connected together by an angled portion generally at right angles to the first and second planes.

4. An apparatus as claimed in claim 3 wherein the door edge connecting portion is operable to be disposed between the edge surface of the door and the door frame and the angled portion is operable to be disposed between an outer surface of the edge portion of the door and the door frame.

5. An apparatus as claimed in claim 1 wherein said frame alignment plane and said door alignment plane are coincident.

6. An apparatus in combination with a pre-hung door unit including a door frame having an inwardly facing portion accessible from an outside facing side of the door unit and a door hingedly connected to the door frame, the apparatus comprising:

a) a body having:

i) door edge portion connecting means for removably connecting the body to an edge portion of the door, said door edge portion connecting means including a door edge connecting portion having a first surface for contacting an edge surface of the door; and ii) frame connecting means connected to the door edge portion connecting means, for removably connecting the body to an inwardly facing portion of the door frame, said frame connecting means including a frame connecting portion having a second surface operable to contact a surface of the inwardly facing portion of the door frame;

b) a door connector having a first receptacle for cooperating with a first retainer for retaining the body against the edge portion of the door; and c) wherein said frame connecting portion includes a frame connector for cooperating with a frame retainer for retaining the body against the door frame, the frame connector including a second receptacle for engaging said frame retainer.

7. An apparatus as claimed in claim 6 wherein the first and second surfaces are flat planar surfaces lying in first and second parallel, spaced apart planes respectively.

8. An apparatus as claimed in claim 7 wherein the door edge connecting portion and frame connecting portion are connected together by an angled portion generally at right angles to the first and second planes.

9. An apparatus as claimed in claim 8 wherein the door edge connecting portion is operable to be disposed between the edge surface of the door and the door frame and the angled portion is operable to be disposed between an outer surface of the edge portion of the door and the door frame.

10. An apparatus as claimed in claim 6 further including aligning means for aligning an inner planar surface of the door with an inside facing surface of the door frame such that said inner planar surface and said inside facing surface of the door frame lie in parallel planes, the aligning means including a frame alignment portion, the frame alignment portion having a flat planar frame alignment surface for contacting said inside facing surface of the door frame, said flat planar frame alignment surface lying in a frame alignment plane and being located at a pre-defined alignment position with respect to the door edge portion connecting means, the aligning means further including a door alignment portion on the body, the door alignment portion having a door alignment surface lying in a door alignment plane, for contacting said inner planar surface of the door, the frame alignment plane and the door alignment plane being parallel to each other.

11. An apparatus as claimed in claim 6 wherein said first receptacle is formed by a first projection extending from said body.

12. An apparatus as claimed in claim 11 wherein said first projection extends longitudinally along said body.

13. An apparatus as claimed in claim 6 wherein said second receptacle includes a second projection extending from said body.

14. An apparatus as claimed in claim 13 wherein said second projection extends longitudinally along said body.

15. An apparatus as claimed in claim 6 further including a first retainer for retaining the body against the edge portion of the door.

16. An apparatus as claimed in claim 15 wherein the first retainer includes a first flexible tension member having first and second end portions, said first end portion being operable to connect to said door connector to secure the first tension member thereto, and the second end portion being operable to connect to the door.

17. An apparatus as claimed in claim 16 wherein said first end portion has a first clip for cooperating with and for connecting to said door connector and wherein said second end portion has a hook member for connecting to a hinge edge of said door, opposite said edge portion of the door to secure the first flexible tension member thereto.

18. An apparatus as claimed in claim 17 wherein said first flexible tension member includes a first tensioner for tensioning said first flexible tension member to urge the body against the edge portion of the door.

19. An apparatus in combination with a pre-hung door unit including a door frame having an inwardly facing portion accessible from an outside facing side of the door unit and a door hingedly connected to the door frame, the apparatus comprising:

a) a body having:

i) door edge portion connecting means for removably connecting the body to an edge portion of the door, said door edge portion connecting means including a door edge connecting portion having a first surface for contacting an edge surface of the door;

ii) frame connecting means connected to the door edge portion connecting means, for removably connecting the body to an inwardly facing portion of the door frame, said frame connecting means including a frame connecting portion having a second surface operable to contact a surface of the inwardly facing portion of the door frame;

iii) a frame connector on the frame connecting portion, wherein the frame connector includes a second projection extending from said body; and b) a frame retainer operable to cooperate with the frame connector to retain the body against the door frame, the frame retainer includes a door frame cooperating portion and a body connecting portion for connecting the frame retainer to the frame connector on the body, such that the frame retainer urges the body against the door frame, wherein:

i) the door frame cooperating portion and the body connecting portion are disposed at an angle relative to each other such that the door frame cooperating portion is operable to contact an outwardly facing surface of the door frame while the body connecting portion is engaged with the frame connector; and ii) the body connecting portion includes a curved projecting portion operable to hook onto said second projection to resist any tendency of the curved projecting portion to come free of said projection.

20. An apparatus as claimed in claim 15 wherein the frame connector includes a web member extending from said frame connecting portion and a bead portion on said web member.

* * * * *